US005938082A

United States Patent [19]

Foster et al.

[11] Patent Number: 5,938,082

[45] **Date of Patent: *Aug. 17, 1999**

[54] CONTAINER ASSEMBLY HAVING SNAP-FIT CONTAINER CONNECTION

[75] Inventors: Donald D. Foster, St. Charles; Mark Ochs, High Ridge, both of Mo.

[73] Assignee: Continental Sprayers International, Inc., St. Peters, Mo.

[ * ] Notice: This patent is subject to a terminal disclaimer.

[21] Appl. No.: 08/985,368

[22] Filed: Dec. 5, 1997

Related U.S. Application Data

[63] Continuation of application No. 08/719,724, Sep. 25, 1996, Pat. No. 5,725,132.

[51] Int. Cl.[6] ..... B67D 5/32

[52] U.S. Cl. ..... 222/153.09; 222/383.1; 215/318

[58] Field of Search ..... 222/153.09, 383.1, 222/382; 239/333; 215/318

[56] References Cited

U.S. PATENT DOCUMENTS

| | | | |
|---|---|---|---|
| 3,656,645 | 4/1972 | Fontenelli . | |
| 3,812,989 | 5/1974 | Horvath . | |
| 4,298,129 | 11/1981 | Stull | 215/318 |
| 4,454,965 | 6/1984 | Kirk, Jr. | 222/383.1 |
| 4,687,113 | 8/1987 | Reeve . | |
| 4,781,311 | 11/1988 | Dunning et al. | 215/318 |
| 5,092,493 | 3/1992 | Pehr . | |
| 5,147,074 | 9/1992 | Battegazzore | 222/153.09 |
| 5,169,032 | 12/1992 | Steijns et al. . | |
| 5,169,033 | 12/1992 | Shay . | |
| 5,238,152 | 8/1993 | Maas et al. . | |
| 5,257,724 | 11/1993 | Steijns . | |
| 5,292,017 | 3/1994 | Reifers . | |
| 5,297,701 | 3/1994 | Steijns et al. . | |
| 5,318,206 | 6/1994 | Maas et al. . | |
| 5,373,955 | 12/1994 | Marino . | |
| 5,423,441 | 6/1995 | Conti . | |
| 5,449,078 | 9/1995 | Akers . | |
| 5,544,778 | 8/1996 | Gonclalves | 215/318 |
| 5,551,582 | 9/1996 | Robinson . | |
| 5,725,132 | 5/1998 | Foster et al. | 222/383.1 |

*Primary Examiner*—Philippe Derakshani
*Attorney, Agent, or Firm*—Howell & Haferkamp, LC

[57] ABSTRACT

A container assembly comprising a container for containing fluid, and a container closure. The container includes a neck having a mouth therein for passage therethrough of liquid in the container, and a flange circumscribing and extending radially outwardly from the neck of the container. The flange includes a generally downwardly facing surface. The container closure comprises a closure cap portion adapted for releasable connection to the neck of the container. The closure cap portion comprises a generally annular-shaped skirt, and at least three protrusions extending generally radially inwardly from an inside surface of the skirt. The protrusions are circumferentially spaced from each other along the inside surface of the skirt. The protrusions of the closure cap portion and the flange of the container are configured for a resilient snap-fit engagement of the protrusions with the generally downwardly facing surface of the flange.

38 Claims, 6 Drawing Sheets

CONTAINER ASSEMBLY HAVING SNAP-FIT CONTAINER CONNECTION

This is a continuation of U.S. patent application Ser. No. 08/719,724, entitled Dispenser With Snap-Fit Container Connection, filed Sep. 25, 1996, now U.S. Pat. No. 5,725,132, issued Mar. 10, 1998.

BACKGROUND OF THE INVENTION

This invention relates to manually-operated reciprocating fluid pumps such as pump-type trigger sprayers.

A trigger sprayer typically includes a dispenser body, a closure cap connected to the dispenser body for securing the trigger sprayer to the neck of a container (or bottle), a dip tube depending from the dispenser body and configured for extending through a mouth (i.e., opening) in the neck of the bottle, and a gasket (or bottle seal) for preventing leakage between the closure cap and the mouth of the container when the closure cap closes the mouth of the container.

The dispenser body has a manually operated pump which draws liquid up the dip tube from the bottle and dispenses it through a nozzle via a liquid flow path in the dispenser body. A priming check valve within the liquid flow path and upstream of the pump permits fluid flow from the container to the pump, but checks fluid flow from the pump back to the container. Another check valve within the liquid flow path and downstream of the pump permits fluid flow from the pump to the nozzle, but checks fluid flow from the nozzle to the pump.

A concern associated with such a trigger sprayer is the cost of manufacture. A typical trigger sprayer is of relatively low cost. However, trigger sprayers with more pieces generally cost slightly more to produce than trigger sprayers with fewer pieces. Millions of trigger sprayers are sold each year for use in dispensing a wide variety of products. Because of the large volumes sold, a savings of even one cent per trigger sprayer is significant.

To reduce the number of trigger sprayer pieces, the closure cap and bottle seal of some conventional trigger sprayers are molded as monolithic (integral) portions of a housing of the trigger sprayer and are made of the same rigid material as the sprayer housing. Because the integral closure cap cannot rotate relative to the trigger sprayer housing, the skirt of the cap does not have a threaded inner surface for engaging a thread on the neck of the bottle. Rather, two diametrically opposite lugs extend radially inwardly from the skirt of the cap and are configured for a snap fit engagement with two diametrically opposite bayonet provisions on the neck of the bottle. The bottle seal of such sprayer is shaped to sealingly engage an inner surface (e.g., inner circumference) of the mouth of the bottle.

A concern with such bayonet-type bottle connection is that the closure cap tends to rock on the bayonet provisions of the bottle. This rocking may result in the bottle seal becoming unsealed from the mouth of the bottle thereby allowing inadvertent leakage of the liquid contents of the bottle between the bottle seal and bottle.

SUMMARY OF THE INVENTION

Among the several objects of the present invention may be noted the provision of an improved dispenser; the provision of such a dispenser which has a minimum number of parts; the provision of such a dispenser which is relatively low in cost; the provision of such a dispenser having a bottle seal and closure cap of a monolithic construction; the provision of such a trigger sprayer and bottle having a releasable connection configured for minimizing rocking of the closure cap relative to the bottle and for minimizing fluid leakage between the closure cap and bottle; the provision of such a trigger sprayer and bottle in which the closure cap is a child resistant closure cap configured to resist removal of the closure cap from the bottle; and the provision of such a fluid pump which is of relatively simple construction.

Generally, a dispenser of the present invention comprises a container for containing fluid to be dispensed and a manually operated reciprocating fluid pump adapted to be secured to the container. The fluid pump includes a pump mechanism, an intake port adapted for fluid communication with liquid contained in the container, an intake liquid flow path providing fluid communication between the intake port and the pump mechanism, a discharge port, a discharge liquid flow path providing fluid communication between the pump mechanism and discharge port, a closure cap portion configured for releasably securing the fluid pump to the container, and a seal portion engageable with the container and shaped and configured for providing a fluid-tight seal between the fluid pump and the container. The container includes a neck having a mouth therein for passage therethrough of liquid in the container. The container further includes a flange circumscribing and extending radially outwardly from the neck of the container. The flange includes a generally downwardly facing surface. The closure cap portion comprises a generally annular-shaped skirt, and at least three protrusions extending generally radially inwardly from an inside surface of the skirt. The protrusions are circumferentially spaced from each other along the inside surface of the skirt. The protrusions of the closure cap and the flange of the container are configured for a resilient snap-fit engagement of the protrusions with the generally downwardly facing surface of the flange when the seal portion of the fluid pump is brought into engagement with the container to releasably maintain the seal portion in fluid-tight sealing engagement with the container.

In another aspect of the present invention, a dispenser comprises a container for containing fluid to be dispensed, and a manually operated reciprocating fluid pump adapted to be secured to the container. The fluid pump includes a closure cap portion, and a seal portion engageable with the container and shaped and configured for providing a fluid-tight seal between the fluid pump and the container. The container includes a neck and a flange circumscribing the neck. The closure cap portion comprises a generally annular-shaped skirt, and at least one protrusion extending generally radially inwardly from an inside surface of the skirt. The protrusion of the closure cap portion and the flange of the container are configured for a resilient snap-fit engagement of the protrusion with the generally downwardly facing surface of the flange when the seal portion of the fluid pump is brought into engagement with the container to releasably maintain the seal portion in fluid-tight sealing engagement with the container. The closure cap portion further includes a first camming surface, and the container further including a second camming surface. The first and second camming surfaces are shaped and configured to engage one another in a manner to cause separation of the protrusion from the flange upon simultaneous application of a radial force against the closure cap and rotation of the closure cap relative to the container. The closure cap portion and container are shaped and configured to permit rotation of the closure cap portion on the container while maintaining the seal portion in fluid-tight sealing engagement with the container when the closure cap is devoid of such radial force.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
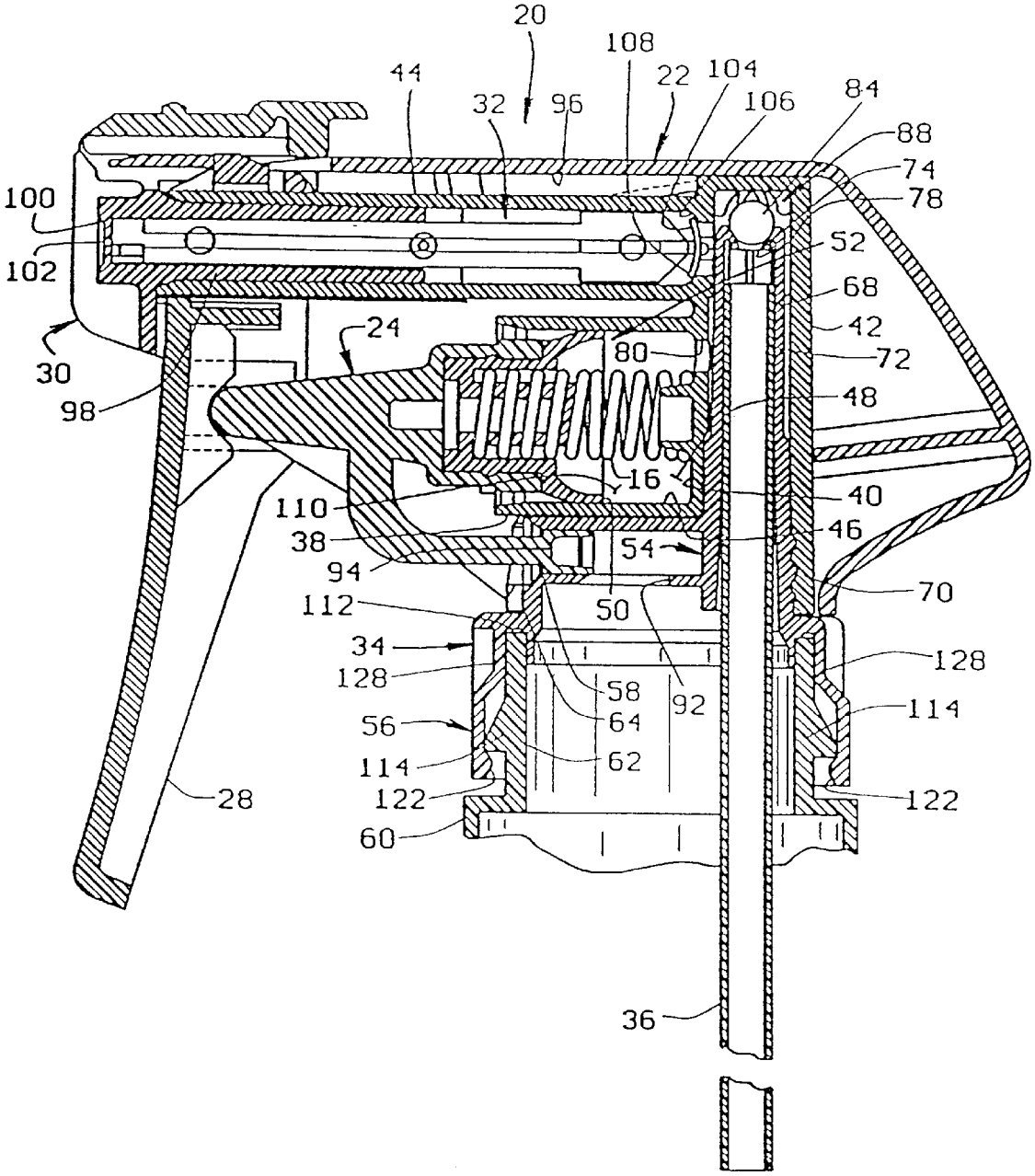
FIG. 1 is a fragmented side elevational view, in section, of a trigger sprayer and bottle (container) of the present invention.

Referring now to the drawings, and first more particularly to FIG. 1, a trigger sprayer of the present invention is indicated in its entirety by the reference numeral 20. Preferably, the trigger sprayer 20 includes: (1) an upper housing member, generally indicated at 22; (2) a plunger, generally indicated at 24, (3) a coil spring 26; (4) a trigger 28; (5) a nozzle assembly, generally indicated at 30; (6) a spinner assembly, generally indicated at 32; (7) a lower member, generally indicated at 34; and (8) a dip tube 36. The upper housing member 22 and plunger 24 constitute a dispenser body.

The upper housing member 22 is preferably a single unitary piece and includes a cylindric wall 38, a circular back wall 40 substantially closing one end (i.e., the right end as viewed in FIG. 1) of the cylindric wall, a generally cylindric vertical formation 42 adjacent the circular back wall, and a horizontal tubular portion 44 extending forward from the vertical formation. The cylindric wall 38 includes a generally cylindric inner surface 46. The cylindric inner surface 46 of the cylindric wall 38 and the circular back wall 40 define a pump chamber, generally indicated at 48 open at one end (i.e., its left end as viewed in FIG. 1) for slidably receiving a piston head 50 of the plunger 24. The pump chamber 48, piston head 50, and spring 26 constitute components of a pump mechanism, generally indicated at 52.

The lower member 34 is a molded, monolithic member and includes a lower housing portion 54, a closure cap portion 56, and a seal portion 58. The lower housing portion 54, closure cap portion 56, and seal portion 58 are a single monolithic piece and are preferably made of a suitable polymeric material such as polypropylene. The closure cap portion 56 is shaped for connection to a container, such as a bottle 60 having a neck 62 and a mouth 64 in the neck for passage therethrough of liquid in the bottle. The closure cap portion 56 and bottle neck 62 is discussed in greater detail below. The seal portion 58 preferably has the shape of an annular lip sized for extending into the bottle mouth 64 and for sealingly engaging the inner circumference of the bottle neck 62.

The lower housing portion 54 includes a tubular portion 66 extending upwardly into a vertical bore 68 of the vertical formation 42 of the upper housing member 22. Preferably, the tubular portion 66 has a lower region 70, an intermediate region 72, and an upper region 74. The lower region 70 of the lower housing tubular portion 66 is sized for a snug fit in the vertical bore 68 of the vertical formation 42 to provide a fluid tight seal therebetween. The intermediate region 72 has an outer diameter which is less than the inner diameter of the housing vertical bore 68. The outer surface of the intermediate region 72 and the surface of the housing vertical bore 68 define an annular fluid passage therebetween. Preferably, the inside diameter of the lower and intermediate regions 70, 72 of the lower member tubular portion 66 are sized for a snug fit of the upper portion of the dip tube 36.

The upper region 74 of the lower member tubular portion 66 includes a check-valve seat 78. The check-valve seat 78 defines an intake port (also referred to by reference number 78) of the trigger sprayer 20. The intake port 78 is in fluid communication with liquid (not shown) contained in the bottle 60 via the dip tube 36.

The upper housing member 22 further includes a lateral opening 80 extending through its circular back wall 40. Preferably, the lateral opening 80 is aligned with the intermediate region 72 of the lower member tubular portion 66 for providing fluid communication between the pump chamber 48 and the annular fluid passage. The upper region 74 of the lower member tubular portion 66, the annular fluid passage, and the lateral opening 80 define an intake liquid flow path providing fluid communication between the intake port 78 and the pump mechanism 52.

The check-valve seat 78 is shaped and configured for receiving a ball 84. The check-valve seat 78 and ball 84 constitute a priming check valve 88 in the intake liquid flow path for permitting fluid flow from the intake port 78 to the pump mechanism 52 and for checking fluid flow from the pump mechanism to the intake port. The ball 84 constitutes a moveable valve member of the priming check valve 88.

The plunger 24 further includes a plug 94 integrally connected to and moveable with the piston head 50. The plug 94 is adapted for closing a bottle vent opening 92 through the closure cap portion 56 of the lower member 34 when the trigger sprayer 20 is not in use, to prevent liquid from spilling out of the bottle via the opening.

The horizontal tubular portion 44 of the upper housing member 22 includes a horizontal bore 96 extending horizontally between a rear portion and a forward end (left end as viewed in FIG. 1) of the upper housing member. The nozzle assembly 30 includes a tubular projection 98 inserted into the horizontal bore 96 via the forward (downstream) end of the bore, a nozzle wall 100 at a forward end of the nozzle tubular projection, and a nozzle orifice 102 through the nozzle wall and in fluid communication with the interior of the bore. The annular fluid passage, the horizontal bore 96, and the interior of the nozzle tubular projection 98 constitute a discharge liquid flow path. The nozzle orifice 102 constitutes a discharge port (also referred to via reference numeral 102) of the discharge liquid flow path. Dispensed liquid flows from the pump chamber 48, through the lateral opening 80, upward through the annular fluid passage, forward through the horizontal bore 96, and then out through the discharge port 102.

The spinner assembly 32 is positioned in the upper housing member's horizontal bore 96 and is held in place by the nozzle tubular projection 98. The spinner assembly 32 includes a resilient disc 104 at its rearward end (right end as viewed in FIG. 1). The resilient disc 104 is engageable with an annular shoulder 106 formed in the upper housing member 22 at the rear end of the horizontal bore 96. The resilient disc 104 and the annular shoulder 106 constitute a discharge check valve, generally indicated at 108, in the discharge liquid flow path for permitting fluid flow from the pump mechanism 52 to the nozzle discharge port 102 and for checking fluid flow from the discharge port 102 to the pump mechanism. In particular, the resilient disc 104 of the spinner assembly 32 constitutes a moveable valve member of the discharge check valve 108 and the annular shoulder 106 of the upper housing member 22 constitutes a valve seat of the discharge check valve. The resilient disc 104 is moveable between a closed position and an open position. In its closed (or seated) position, the resilient disc 104 sealing engages the annular shoulder 106 all around the shoulder to prevent passage of liquid therethrough. In its open (unseated) position, at least a part of the resilient disc 104 flexes forwardly away from the annular shoulder 106 to thereby provide a gap between the resilient disc and the shoulder to allow liquid to flow therethrough.

The piston head 50 of the plunger 24 is preferably formed of a suitable resilient material such as low density polyethylene. The piston head 50 comprises the rearward end (the right most end as viewed in FIG. 1) of the plunger 24. The piston head 50 is slidable within the pump chamber 48 and configured for sealing engagement with the cylindric inner surface 46 of the pump chamber 48 all around the piston head 50 to seal against leakage of fluid between the plunger 24 and cylindric inner surface 46 of the upper housing member 22. The piston head 50 and pump chamber 48 define a variable volume fluid receiving cavity 110. The piston head 50 is reciprocally slidable in the pump chamber 48 between a forward (extended) position and a rearward (compressed) position. The plunger 24 is manually moved from its extended position to its compressed position by depressing the trigger 28. The coil spring 26 is positioned between the circular back wall 40 of the pump chamber 48 and the plunger 24 for urging the plunger forward to its extended position. Thus, the plunger 24 is rearwardly moved from its extended position to its compressed position by manually squeezing the trigger 28, and is automatically returned to its extended position via the piston spring 26 when the operator releases the trigger.

Figure 3:
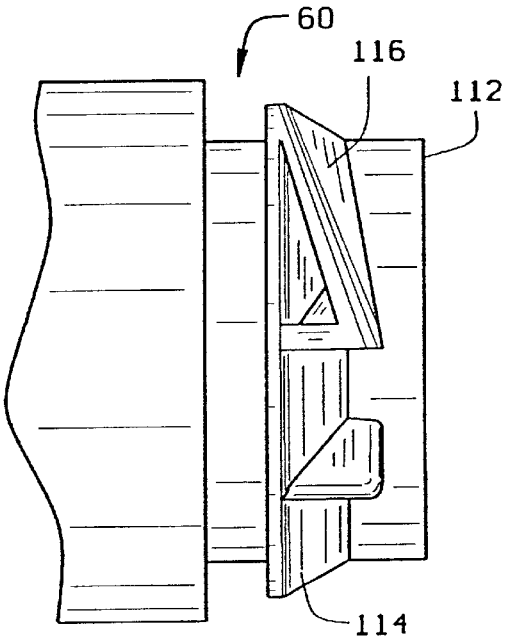
FIG. 3 is a fragmented side elevational view of the bottle finish of FIG. 2.
Figure 2:
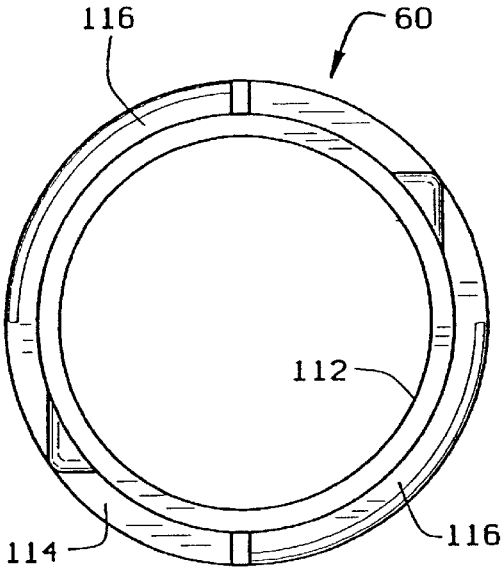
FIG. 2 is a fragmented top plan view of the bottle finish of the bottle of FIG. 1.
Figure 4:
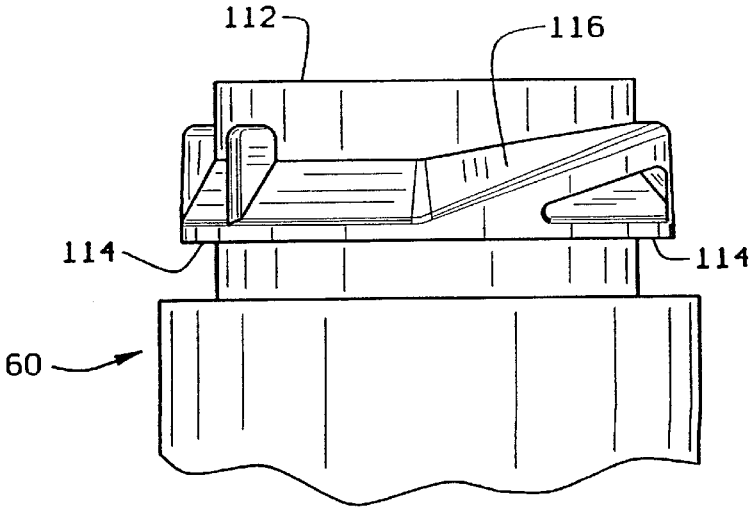
FIG. 4 is a fragmented front elevational view of the bottle finish of FIGS. 2 and 3.
Figure 7:
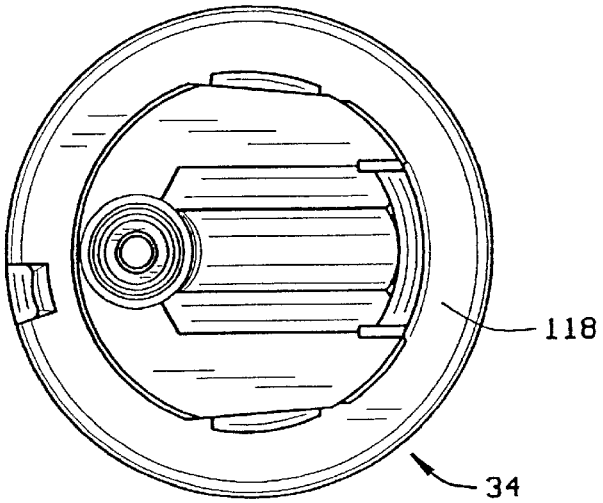
FIG. 7 is a top plan view of the lower member of FIG. 5.
Figure 5:
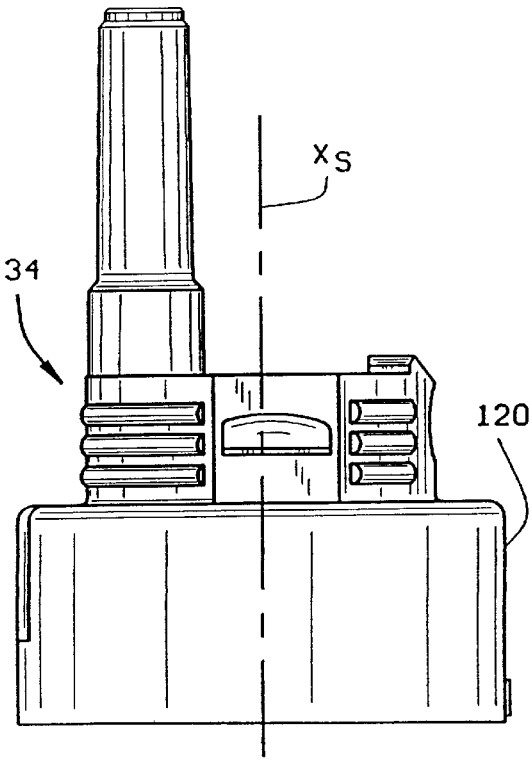
FIG. 5 is a front elevational view of a lower member of the trigger sprayer of FIG. 1.
Figure 6:
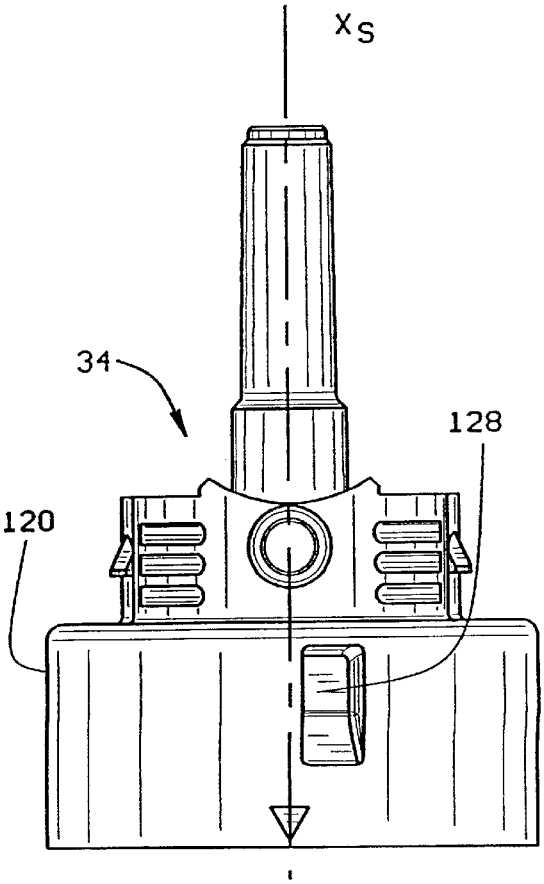
FIG. 6 is a side elevational view of the lower member of FIG. 5.
Figure 8:
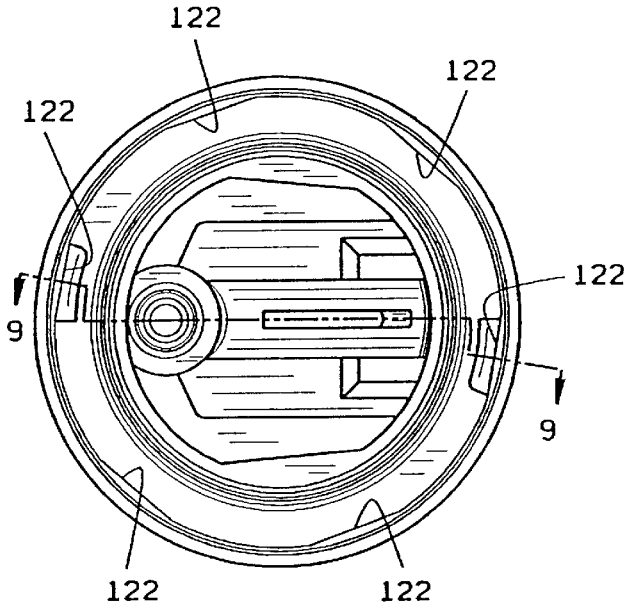
FIG. 8 is a bottom plan view of the lower member of FIG. 5.
Figure 9:
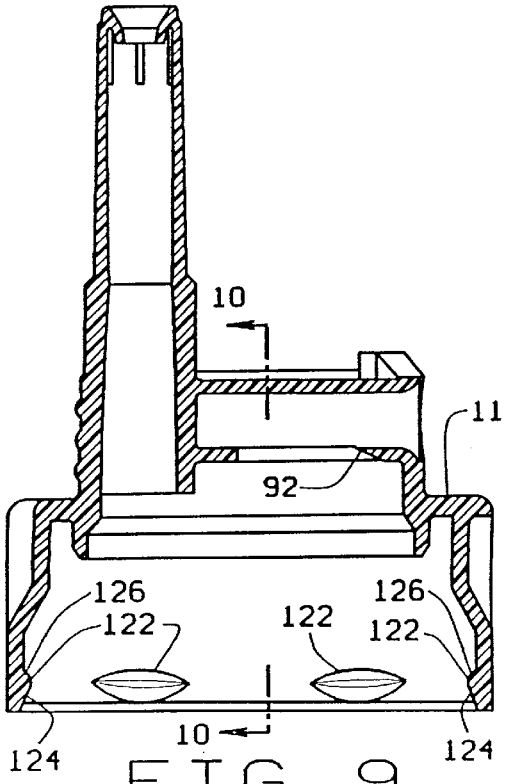
FIG. 9 is a cross-sectional view taken along the plane of line 9—9 of FIG. 8.
Figure 10:
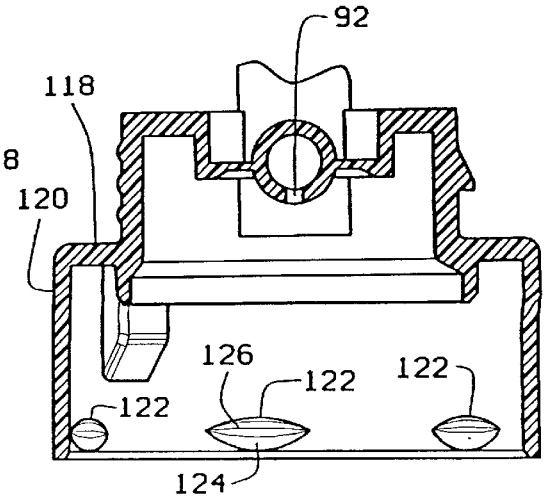
FIG. 10 is a cross-sectional view taken along the plane of line 10—10 of FIG. 9.

Referring now to FIGS. 2–4, the bottle 60 includes an upper rim 112 defining the mouth of the bottle, and a flange 114 circumscribing and extending radially outwardly from the neck 62 of the bottle. Preferably, the flange 114 is spaced below the upper rim 112 of the bottle. The bottle 60 further includes two inclined surfaces or ramps 116 which extend upward in an inclined manner from an upper surface of the flange 114. Preferably, the ramps 116 are diametrically opposite one another.

Referring now to FIGS. 5–10, the closure cap portion 56 includes a disc-shaped portion 118 and an annular skirt 120 circumscribing and depending down from the disc-shaped portion. The annular skirt 120 has a central skirt axis $X_s$ which is preferably concentric to the annular skirt and generally perpendicular to the disc-shaped portion 118. The annular skirt 120 is sized and configured for surrounding the outer surface of the neck 62 of the bottle 60. The seal portion 58 depends downwardly from the disc-shaped portion 118. It is circumscribed by, generally coaxial with, and spaced radially inwardly of the annular skirt 120. The seal portion 58 is shaped for sealingly engaging the inner surface of the bottle's neck 62 all around such inner surface when the skirt is secured to the outer surface of the bottle's neck.

A plurality of protrusions 122 (and preferably six protrusions) extend generally radially inwardly from an inner surface of the skirt 120. The protrusions 122 are circumferentially spaced from each other along the inside surface of the skirt 120. The protrusions 122 of the closure cap portion and the flange 114 of the bottle 60 are configured for a resilient snap-fit engagement of the protrusions with a downwardly facing surface (i.e., underside) of the flange when the seal portion 58 of the fluid pump is brought into engagement with the upper rim 112 of the bottle. This snap-fit engagement maintains the seal portion 58 in fluid-tight sealing engagement with the container. As viewed in longitudinal cross-section (FIG. 9), each protrusion 122 includes a sloped lower surface 124 and an upper shoulder 126. As the closure cap portion 56 is pressed over the neck 62 of the bottle, the slope of the lower surfaces 124 of the protrusions 122 cause the protrusions to push against the flange 114 of the bottle 60 in a manner to cause radial expansion of the closure cap portion upon radial expansion of the closure cap portion with respect to the bottle. When the closure cap portion 56 is fully inserted on the neck 62 of the bottle 60, the upper shoulders 126 of the protrusions 122 engage the underside of the flange 114 to securely lock the closure cap portion to the bottle. Because there are at least three protrusions 122 (and preferably six), the protrusions limit rocking of the closure cap portion 56 and thereby maintain a fluid tight seal of the seal portion 58 with the upper rim 112 of the bottle.

The closure cap portion 56 further includes two lugs 128 extending radially inwardly from the skirt 120 of the closure cap portion. Preferably, the lugs 128 are diametrically opposite one another. The lugs 128 are engageable with the ramps 116 of the bottle upon counterclockwise rotation of the closure cap portion 56 with respect to the bottle. The lugs 128 and ramps 116 constitute means for facilitating disengagement of the protrusions 122 with the flange 114 of the bottle 60 to thereby facilitate removal of the closure cap portion 56 from the bottle. The surfaces of the lugs 128 constitute first camming surfaces, and the ramps constitute second camming surfaces. These camming surfaces (i.e., the lugs 128 and ramps 116) are engageable with one another when the protrusions 122 are in engagement with the flange 114 and when the seal portion 58 is in engagement with the upper rim 112 of the bottle. The camming surfaces are shaped and configured to press against one another in a manner to cause upward movement of the closure cap portion 56 upon counterclockwise rotation of the closure cap portion relative to the container. This upward movement causes the flange 114 to press against the protrusions 122 to thereby cause radial expansion of the closure cap portion 56 and thus facilitate removal of the closure cap portion from the bottle. Also, because the lugs 128 are diametrically opposite one another and the ramps 116 are diametrically opposite one another, the lugs simultaneously push against the ramps upon rotation of the closure cap portion 56.

Figure 11:
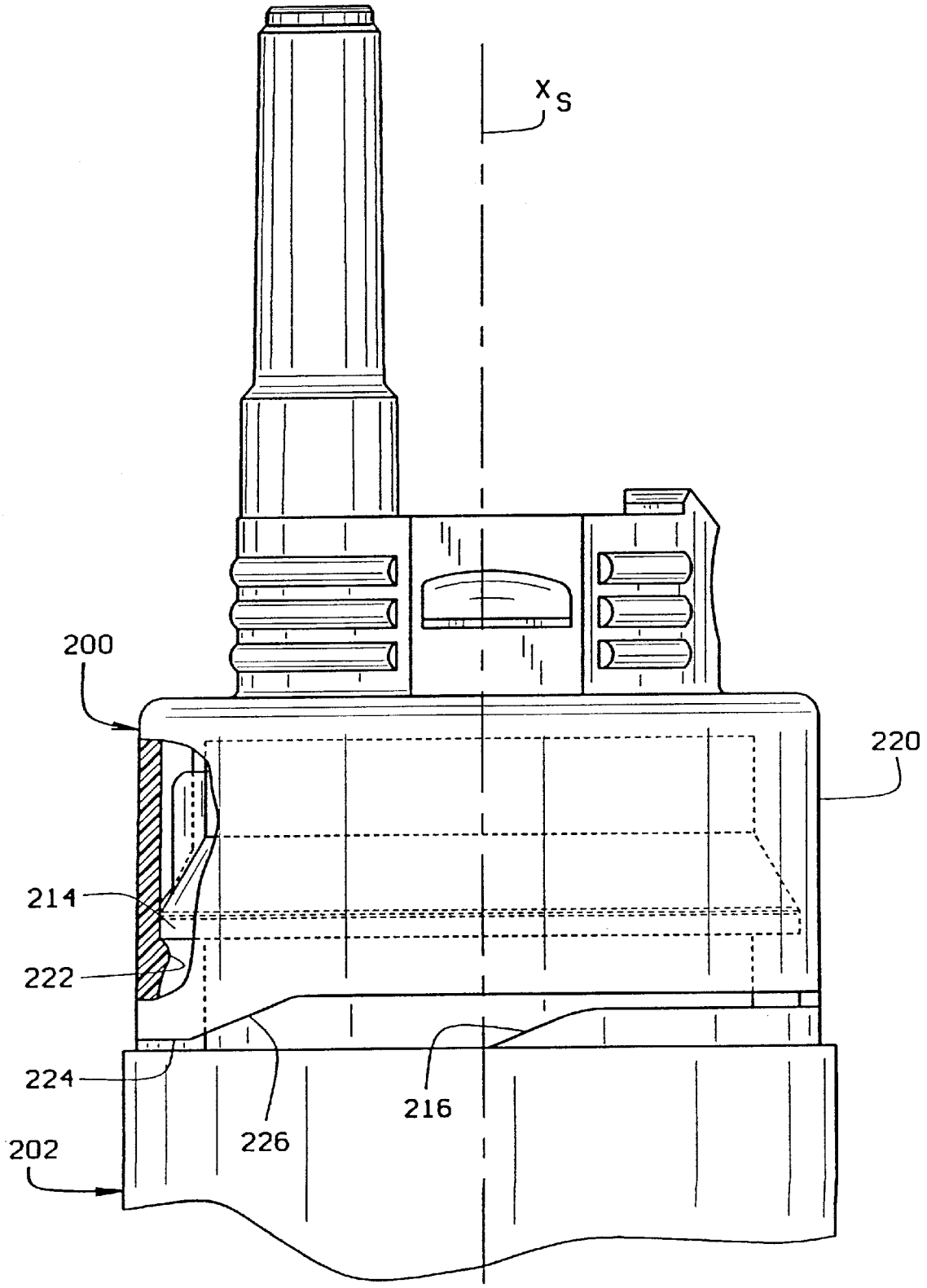
FIG. 11 is a fragmented front elevational view of a lower member and bottle finish of a second embodiment of a dispenser of the present invention, with portions of the lower member broken away to show detail.
Figure 12:
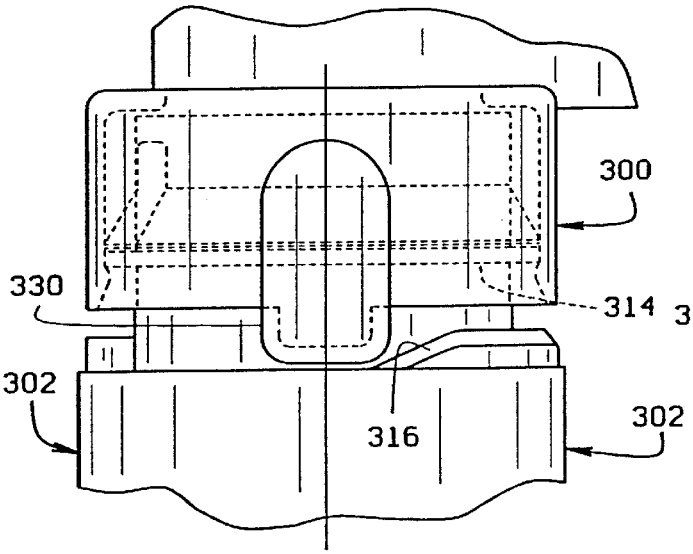
FIG. 12 is a fragmented front elevational view of a lower member and bottle finish of a third embodiment of a dispenser of the present invention with portions of the lower member broken away to show detail, the lower member being a child-resistant member having downwardly extending flexible tabs configured to facilitate removal of the lower member from the bottle.
Figure 14:
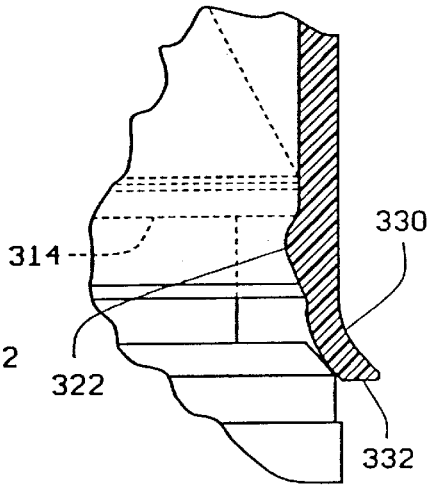
FIG. 14 is a fragmented vertical cross-sectional view of the lower member and bottle finish of FIG. 12 showing one of the tabs flexed radially outwardly.
Figure 13:
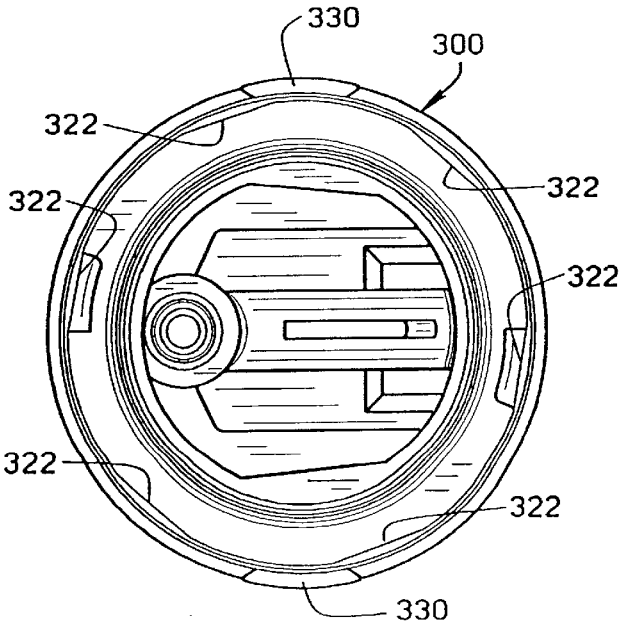
FIG. 13 is a bottom plan view of the lower member of FIG. 12.

FIG. 11 shows a lower member, generally indicated at 200, and a bottle, generally indicated at 202, of a second embodiment of a dispenser of the present invention. The bottle 202 includes a flange 214 and two diametrically opposite inclined surfaces (or ramps) 216 (only one of which is shown in FIG. 11). Preferably, the ramps 216 are spaced below the flange 214.

The lower member 200 is similar to the lower member 34 of FIG. 1 and includes an annular skirt 220 having a plurality (e.g., six) of protrusions 222 identical to the protrusions 122 of the embodiment of FIGS. 1–10. The protrusions are configured to engage the underside of the flange 214. Unlike the skirt 120, the skirt 220 does not include lugs. Instead, the skirt 220 has a skirt lower edge 224 including two diametrically opposite inclined surfaces 226 (only one of which is shown in FIG. 11). The inclined surfaces 226 constitute first camming surfaces and the ramps 216 constitute second camming surfaces. The inclined surfaces 226 and ramps 216 are configured to press against one another upon counterclockwise rotation of the skirt 220 with respect to the bottle 202 to force the lower member 200 up and away from the bottle to thereby cause disengage the protrusions from the flange. Thus, the inclined surfaces 226 and ramps 216 constitute means for facilitating disengagement of the protrusions 222 from the flange 214 of the bottle 202 to thereby facilitate removal of the lower member 200 from the bottle.

FIGS. 12–15 show a lower member, generally indicated at 300, and a bottle, generally indicated at 302, of a third embodiment of a dispenser of the present invention. The bottle 302 is identical to the bottle 202 of FIG. 11 and includes a flange 314 and two diametrically opposite inclined surfaces (or ramps) 316 (only one of which is shown in FIG. 11).

The lower member 300 is similar to the lower member 200 of FIG. 11 and includes an annular skirt 320 having a plurality of protrusions (e.g., six protrusions) 322 identical to the protrusions 222 of the embodiment of FIG. 11. The protrusions are configured to engage the underside of the flange 314. Two tabs 330 extend downwardly from diametrically opposite portions of the skirt 320. The tabs 330 and skirt 320 are of a single monolithic construction. However, because of the size and shape of the tabs 330, they are generally flexible. The tabs 330 preferably include inclined surfaces 332 engageable with the ramps 316 of the bottle 302 upon rotation of the lower member 300 relative to the bottle. When the lower member is rotated to the point where the inclined surfaces 332 of the tabs 330 engage the ramps 316, further rotation of the lower member causes the ramps to push against the tabs, thereby causing the tabs to flex outwardly substantially in the manner illustrated in FIG. 14. With the tabs 330 flexed outwardly, the inclined surfaces 332 are out of engagement with the ramps 316 and therefore no upwardly directed force is exerted against the closure cap portion.

Figure 15:
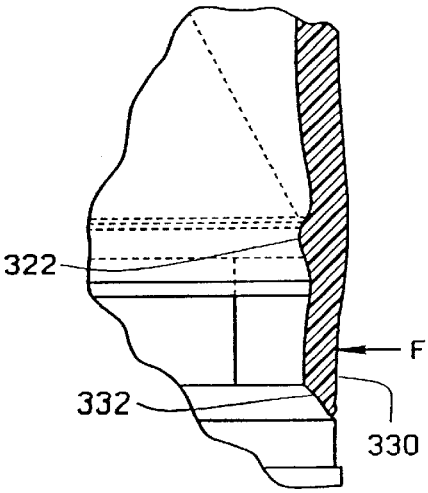
FIG. 15 is a fragmented vertical cross-sectional view similar to that of FIG. 14 but having a radially inward force applied against the tab to prevent flexing of the tab.

As shown in FIG. 15, applying finger pressure (or otherwise applying a radially inwardly directed force F) to the tabs 330 while rotating the closure cap portion prevents outward flexing of the tabs upon rotation of the closure cap. Thus, simultaneous application of a radial force against the closure cap and rotation of the closure cap relative to the bottle causes the inclined surfaces 332 (e.g., first camming surfaces) of the tabs 330 to push against the ramps 316 (e.g., second camming surfaces) of the bottle in a manner to cause separation of the protrusion from the flange, i.e., in a manner to cause upward movement of the closure cap portion relative to the bottle. Preferably, the force necessary to limit flexing of the tabs is greater than that which can be generated by the finger pressure of a typical child, but not greater than that which can be generated by the finger pressure of a typical adult. In other words, a typical adult can remove the lower member 300 from the bottle 302, but a typical child cannot. Thus, the seal portion of the lower member is maintained in fluid-tight sealing engagement with the bottle when the tabs are not squeezed to a sufficient degree (i.e., when the tabs are devoid of a sufficient radial force). Therefore, the lower member 300 and bottle 302 are child resistant.

Although the preferred embodiments have been described as being trigger sprayers, it is to be understood that other pump-type dispensers (e.g., lotion dispensers, etc.) are also encompassed by this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A container assembly comprising:

a container for containing fluid, the container including a neck having an upper end margin with a cylindric outer surface, the neck further including an upper rim defining a mouth therein for passage therethrough of liquid in the container, the container further including a flange circumscribing and extending radially outwardly from the neck of the container, the flange spaced below the upper rim, the cylindric outer surface being between the upper rim and the flange, the flange including a generally downwardly facing surface; and a container closure comprising a closure cap portion adapted for releasable connection to the neck of the container, the closure cap portion comprising a generally annular-shaped skirt, at least three protrusions extending generally radially inwardly from an inside surface of the skirt, the protrusions being circumferentially spaced from each other along the inside surface of the skirt;

the protrusions of the closure cap portion and the flange of the container being configured for a resilient snap-fit engagement of the protrusions with the generally downwardly facing surface of the flange.

2. A container assembly as set forth in claim 1 wherein the container closure further comprises a seal portion engageable with the container and shaped and configured for providing a fluid-tight seal between the container closure and the container when the protrusions of the closure cap portion are in engagement with the generally downwardly facing surface of the flange of the container.

3. A container assembly as set forth in claim 2 wherein the seal portion sealingly engages an inner portion of the upper rim all around the upper rim when the protrusions of the closure cap portion engage the generally downwardly facing surface of the flange.

4. A container assembly as set forth in claim 3 wherein the closure cap portion and container further comprise means for facilitating disengagement of the protrusions of the closure cap portion with the flange of the container to thereby facilitate removal of the closure cap portion from the container.

5. A container assembly as set forth in claim 4 wherein said means for facilitating disengagement comprises at least one first camming surface on the closure cap portion, and at least one second camming surface on the container, said first camming surface being engageable with the second camming surface when the protrusions are in engagement with the flange, said first and second camming surfaces being configured to press against one another in a manner to cause separation of the protrusions from the flange upon rotation of the closure cap portion with respect to the container.

6. A container assembly as set forth in claim 5 wherein said first and second camming surfaces are configured to press against one another in a manner to cause radial expansion of the closure cap portion upon rotation of the closure cap portion with respect to the container.

7. A container assembly as set forth in claim 1 further comprising at least one first camming surface on the closure cap portion, and at least one second camming surface on the container, said first camming surface being engageable with the second camming surface when the protrusions are in engagement with the flange, said first and second camming surfaces being configured to press against one another in a manner to cause separation of the protrusions from the flange upon rotation of the closure cap portion with respect to the container.

8. A container assembly as set forth in claim 7 wherein said first and second camming surfaces are configured to press against one another in a manner to cause radial expansion of the closure cap portion upon rotation of the closure cap portion with respect to the container.

9. A container assembly as set forth in claim 7 wherein said first and second camming surfaces are configured to press against one another in a manner to cause upward movement of the closure cap portion upon rotation of the closure cap portion with respect to the container.

10. A container assembly as set forth in claim 9 wherein:

said at least one first camming surface comprises at least two lugs extending radially inwardly from the skirt of the closure cap portion;

said at least one second camming surface comprises at least two inclined surfaces on the neck of the container; and said lugs and said inclined surfaces being positioned and arranged so that the inclined surfaces simultaneously push against the lugs upon rotation of the closure cap portion with respect to the container.

11. A container assembly as set forth in claim 10 wherein said lugs are diametrically opposite one another, and wherein said inclined surfaces are diametrically opposite one another.

12. A container assembly as set forth in claim 9 wherein:

the skirt of the closure cap portion has a skirt lower edge, said first camming surface comprising at least one inclined surface on the skirt lower edge;

said at least one second camming surface comprises at least one inclined surface on the neck of the container;

said inclined surface of the skirt lower edge and said inclined surface of the container being positioned and arranged so that the inclined surfaces simultaneously push against one another upon rotation of the closure cap portion with respect to one another.

13. A container assembly as set forth in claim 12 wherein:

said at least one inclined surface on the skirt lower edge comprises two inclined surfaces on the skirt lower edge which are diametrically opposite one another; and said at least one inclined surface on the neck of the container comprises two inclined surfaces on the neck of the container which are diametrically opposite one another.

14. A container assembly as set forth in claim 7 wherein the skirt is configured to flex radially outwardly as the skirt is placed around the neck of the container, the skirt being configured for resiliently snapping radially inwardly when the closure cap portion is moved downward on the neck of the container to a position in which the protrusions are positioned below the flange.

15. A container assembly as set forth in claim 7 wherein the container closure further comprises a seal portion engageable with the container and shaped and configured for providing a fluid-tight seal between the container closure and the container when the protrusions of the closure cap portion are in engagement with the generally downwardly facing surface of the flange of the container.

16. A container assembly as set forth in claim 15 wherein the skirt of the closure cap portion circumscribes and is spaced radially from the seal portion, the seal portion having an annular outer surface sized and configured for sealingly engaging an inner annular surface of the neck of the container all around the seal portion's annular outer surface when the protrusions of the closure cap portion are in snap-fit engagement with the flange of the container.

17. A container assembly as set forth in claim 15 wherein the seal portion and closure cap portion are of a molded one piece construction.

18. A container assembly as set forth in claim 2 wherein the closure cap portion further includes a first camming surface, and wherein the container further includes a second camming surface, the first and second camming surfaces being shaped and configured to engage one another in a manner to cause separation of the protrusions from the flange upon simultaneous application of a radial force against the closure cap portion and rotation of the closure cap portion relative to the container, the closure cap portion and container being shaped and configured to permit rotation of the closure cap portion on the container while maintaining the seal portion in fluid-tight sealing engagement with the container when the closure cap portion is devoid of such radial force.

19. A container assembly comprising:

a container for containing fluid, the container including a neck having an upper end margin with a cylindric outer surface, the neck further including an upper rim defining a mouth therein for passage therethrough of liquid in the container, the container further including a flange circumscribing and extending radially outwardly from the neck of the container, the flange spaced below the upper rim, the cylindric outer surface being between the upper rim and the flange, the flange including a generally downwardly facing surface; and a container closure comprising a closure cap portion adapted for releasable connection to the neck of the container, and a seal portion engageable with the container and shaped and configured for providing a fluid-tight seal between the container closure and the container, the closure cap portion comprising a generally annular-shaped skirt, at least one protrusion extending generally radially inwardly from an inside surface of the skirt;

the protrusion of the closure cap portion and the flange of the container being configured for a resilient snap-fit engagement of the protrusion with the generally downwardly facing surface of the flange when the seal portion of the container closure is brought into engagement with the container to releasably maintain the seal portion in fluid-tight sealing engagement with the container;

the closure cap portion further including a first camming surface, and the container further including a second camming surface, the first and second camming surfaces being shaped and configured to engage one another in a manner to cause separation of the protrusion from the flange upon simultaneous application of a radial force against the closure cap portion and rotation of the closure cap portion relative to the container, the closure cap portion and container being shaped and configured to permit rotation of the closure cap portion on the container while maintaining the seal portion in fluid-tight sealing engagement with the container when the closure cap portion is devoid of such radial force.

20. A container assembly as set forth in claim 19 wherein said first and second camming surfaces are shaped and configured to press against one another in a manner to cause upward movement of the closure cap portion upon simultaneous application of a radial force against the closure cap portion and rotation of the closure cap portion relative to the container.

21. A container for a container assembly having a container and a container closure, the container closure including a closure cap portion, the closure cap portion comprising a generally annular-shaped skirt, at least three protrusions extending generally radially inwardly from an inside surface of the skirt, and at least one first camming surface, the protrusions being circumferentially spaced from each other along the inside surface of the skirt, the container comprising:

a neck having an upper end margin with a cylindric outer surface, the neck further including an upper rim defining a mouth therein for passage therethrough of liquid in the container, the neck being adapted for releasable connection of the closure cap thereto;

a flange circumscribing and extending radially outwardly from the neck of the container, the flange including a generally downwardly facing surface, the flange spaced below the upper rim, the cylindric outer surface being between the upper rim and the flange, and the flange shaped and configured for a resilient snap-fit engagement of the protrusions with the generally downwardly facing surface of the flange; and at least one second camming surface on the neck, the second camming surface being shaped and adapted for engaging the first camming surface when the protrusions are in engagement with the flange, the second camming surface being configured to press the first camming surface in a manner to cause separation of the protrusions from the flange upon rotation of the closure cap portion with respect to the container.

22. A container as set forth in claim 21 wherein said second camming surface is configured to press against the first camming surface in a manner to cause radial expansion of the closure cap portion upon rotation of the closure cap portion with respect to the container.

23. A container as set forth in claim 22 wherein the second camming surface is configured to press against the first camming surface in a manner to cause upward movement of the closure cap portion upon rotation of the closure cap portion with respect to the container.

24. A container as set forth in claim 23 wherein said at least one second camming surface comprises at least two inclined surfaces on the neck of the container, said two inclined surfaces being diametrically opposite one another, the inclined surfaces being adapted to simultaneously push against camming surfaces of the closure cap portion upon rotation of the closure cap portion with respect to the container.

25. A container as set forth in claim 23 wherein the skirt of the closure cap portion has a skirt lower edge, the first camming surface comprising at least one inclined surface on the skirt lower edge, said at least one second camming surface comprising at least one inclined surface on the neck of the container, the inclined surface of the container being positioned and arranged so that it pushes against the inclined surface on the skirt lower edge upon rotation of the closure cap portion with respect to the neck of the container.

26. A container assembly comprising:

a container for containing fluid, the container including a neck having a mouth therein for passage therethrough of liquid in the container, the container further including a flange circumscribing and extending radially outwardly from the neck of the container, the flange including and generally downwardly facing surface;

a container closure comprising a closure cap portion adapted for releasable connection to the neck of the container, the closure cap portion comprising a generally annular-shaped skirt, at least three protrusions extending generally radially inwardly from an inside surface of the skirt, the protrusions being circumferentially spaced from each other along the inside surface of the skirt, the protrusions of the closure cap portion and the flange of the container being configured for a resilient snap-fit engagement of the protrusions with the generally downwardly facing surface of the flange; and at least one first camming surface on the closure cap portion, and at least one second camming surface on the container, said first camming surface being engageable with the second camming surface when the protrusions are in engagement with the flange, said first and second camming surfaces being configured to press against one another in a manner to cause separation of the protrusions from the flange upon rotation of the closure cap portion with respect to the container, said first and second camming surfaces also being configured to press against one another in a manner to cause upward movement of the closure cap portion upon rotation of the closure cap portion with respect to the container;

wherein said at least one first camming surface comprises at least two lugs extending radially inwardly from the skirt of the closure cap portion;

said at least one second camming surface comprises at least two inclined surfaces on the neck of the container; and said lugs and said inclined surfaces being positioned and arranged so that the inclined surfaces simultaneously push against the lugs upon rotation of the closure cap portion with respect to the container.

27. A container assembly as set forth in claim 26 wherein said lugs are diametrically opposite one another, and wherein said inclined surfaces are diametrically opposite one another.

28. A container assembly comprising:

a container for containing fluid, the container including a neck having a mouth therein for passage therethrough of liquid in the container, the mouth having a generally annular-shaped upper rim, the container further including a flange circumscribing and extending radially outward from the neck of the container, the flange including a generally downwardly facing surface;

a container closure comprising a closure cap portion adapted for releasable connection to the neck of the container, the closure cap portion comprising a generally annular-shaped skirt, at least three protrusions extending generally radially inwardly from an inside surface of the skirt, the protrusions being circumferentially spaced from each other along the inside surface of the skirt;

the protrusions of the closure cap portion and the flange of the container being configured for a resilient snap-fit engagement of the protrusions with the generally downwardly facing surface of the flange;

and further comprising at least one first camming surface on the closure cap portion, and at least one second camming surface on the container, said first camming surface being engageable with the second camming surface when the protrusions are in engagement with the flange, said second camming surface being located between the generally downwardly facing surface of the flange and the upper rim;

said first and second camming surfaces being configured to press against one another in a manner to cause separation of the protrusions from the flange upon rotation of the closure cap portion with respect to the container.

29. A container assembly as set forth in claim 28 wherein said first and second camming surfaces are configured to press against one another in a manner to cause radial expansion of the closure cap portion upon rotation of the closure cap portion with respect to the container.

30. A container assembly as set forth in claim 28 wherein said first and second camming surfaces are configured to press against one another in a manner to cause upward movement of the closure cap portion upon rotation of the closure cap portion with respect to the container.

31. A container assembly as set forth in claim 30 wherein:

said at least one first camming surface comprises at least two lugs extending radially inwardly from the skirt of the closure cap portion;

said at least one second camming surface comprises at least two inclined surfaces on the neck of the container; and said lugs and said inclined surfaces being positioned and arranged so that the inclined surfaces simultaneously push against the lugs upon rotation of the closure cap portion with respect to the container.

32. A container assembly as set forth in claim 31 wherein said lugs are diametrically opposite one another, and wherein said inclined surfaces are diametrically opposite one another.

33. A container assembly as set forth in claim 30 wherein:

the skirt of the closure cap portion has a skirt lower edge, said first camming surface comprising at least one inclined surface on the skirt lower edge;

said at least one second camming surface comprises at least one inclined surface on the neck of the container;

said inclined surface of the skirt lower edge and said inclined surface of the container being positioned and arranged so that the inclined surfaces simultaneously push against one another upon rotation of the closure cap portion with respect to one another.

34. A container assembly as set forth in claim 33 wherein:

said at least one inclined surface on the skirt lower edge comprises two inclined surfaces on the skirt lower edge which are diametrically opposite one another; and said at least one inclined surface on the neck of the container comprises two inclined surfaces on the neck of the container which are diametrically opposite one another.

35. A container assembly as set forth in claim 28 wherein the skirt is configured to flex radially outwardly as the skirt is placed around the neck of the container, the skirt being configured for resiliently snapping radially inwardly when the closure cap portion is moved downward on the neck of the container to a position in which the protrusions are positioned below the flange.

36. A container assembly as set forth in claim 28 wherein the container closure further comprises a seal portion engageable with the container and shaped and configured for providing a fluid-tight seal between the container closure and the container when the protrusions of the closure cap portion are in engagement with the generally downwardly facing surface of the flange of the container.

37. A container assembly as set forth in claim 36 wherein the skirt of the closure cap portion circumscribes and is spaced radially from the seal portion, the seal portion having an annular outer surface sized and configured for sealingly engaging an inner annular surface of the neck of the container all around the seal portion's annular outer surface when the protrusions of the closure cap portion are in snap-fit engagement with the flange of the container.

38. A container assembly as set forth in claim 36 wherein the seal portion and closure cap portion are of a molded one piece construction.

* * * * *